US005447181A

United States Patent [19]

Tahara et al.

[11] Patent Number: 5,447,181

[45] Date of Patent: Sep. 5, 1995

[54] LOOM GUIDE BAR BLADE WITH ITS SURFACE NITRIDED FOR HARDENING

[75] Inventors: Masaaki Tahara, Takatsuki; Haruo Senbokuya, Tondabayashi; Kenzo Kitano, Kawachinagano; Tadashi Hayashida, Sakai; Teruo Minato, Hashimoto, all of Japan

[73] Assignee: Daido Hoxan Inc., Sapporo, Japan

[21] Appl. No.: 162,466

[22] Filed: Dec. 7, 1993

[51] Int. Cl.[6] ..... D03D 49/62

[52] U.S. Cl. ..... 139/192; 148/206

[58] Field of Search ..... 139/192, 435.6; 148/206

[56] References Cited

U.S. PATENT DOCUMENTS

| | | | |
|---|---|---|---|
| 3,715,884 | 2/1973 | Sanders | 59/78 |
| 3,882,695 | 5/1975 | Flicker | 66/115 |
| 4,655,259 | 4/1987 | Steiner | 139/435.6 X |
| 4,969,378 | 11/1990 | Lu et al. | 76/108.2 |
| 4,975,147 | 12/1990 | Tahara et al. . | |
| 5,013,371 | 5/1991 | Tahara et al. . | |
| 5,069,861 | 12/1991 | Lagarrigue | 376/260 |
| 5,112,030 | 5/1992 | Tahara et al. . | |
| 5,114,500 | 5/1992 | Tahara et al. . | |
| 5,141,567 | 8/1992 | Tahara . | |
| 5,176,889 | 1/1993 | Yoshino et al. . | |
| 5,252,145 | 10/1993 | Tahara et al. . | |
| 5,254,181 | 10/1993 | Yoshino et al. . | |
| 5,258,022 | 11/1993 | Davidson | 623/2 |
| 5,340,412 | 8/1994 | Yoshino et al. | 148/208 |

FOREIGN PATENT DOCUMENTS

| | | | |
|---|---|---|---|
| 0550752A1 | 7/1993 | European Pat. Off. . | |
| 0551702A1 | 7/1993 | European Pat. Off. . | |
| 0569637A1 | 11/1993 | European Pat. Off. . | |
| 0052658 | 3/1985 | Japan | 139/192 |
| 0162840 | 8/1985 | Japan | 139/435.6 |
| 1201054 | 9/1986 | Japan | 139/192 |
| 2199851 | 9/1987 | Japan | 139/192 |
| 62199851 | 9/1987 | Japan . | |
| 590949 | 8/1977 | Switzerland | 139/192 |

OTHER PUBLICATIONS

European Search Report for EP 93 31 0104 having a date of search of May 18, 1994.

*Primary Examiner*—Andrew M. Falik

*Attorney, Agent, or Firm*—Armstrong, Westerman, Hattori, McLeland and Naughton

[57] ABSTRACT

A loom guide bar blade for automatic weaving machinery such as an air or water jet loom wherein the surface of the blade which contacts yarn is nitrided to form a nitrided hardened layer. When this blade is used in automatic high-speed weaving machinery, wearing and the like at contacting points of the blade with the yarn are prevented. As a result yarn fluffing from its being abraded by a roughened blade surface is minimized.

11 Claims, 2 Drawing Sheets

LOOM GUIDE BAR BLADE WITH ITS SURFACE NITRIDED FOR HARDENING

FIELD OF THE INVENTION

This invention relates to a loom guide bar blade or reed dent with its surface nitrided for hardening, the blade used for an automatic loom such as an air jet loom or a water jet loom.

BACKGROUND OF THE INVENTION

Generally, plural pieces of guide bar blades 10 shown in FIG. 1 and not less than two guide bars incorporated into a frame 32 shown in FIG. 2 are installed into an automatic loom. More strict wear resistance has become required for loom guide bar blades used for an air jet loom or a water jet loom with the recent speed-up of such automatic looms. Heretofore, a material such as metastable austenitic stainless steel, remarkably superior in work hardening, or ferritic stainless steel, wherein the surface is hard-plated, has been employed as a material for the above guide bar blades in order to maintain corrosion resistance as well as the above wear resistance.

However, recently, further speed-up of weaving machinery has been promoted. The above materials involve a problem from the viewpoint of wear resistance in promoting the further speed-up. Namely, a Vickers hardness of about 500 Hv is the limit in improving the hardness of metastable austenitic stainless steel by work hardening. Since the above material cannot withstand high-speed rotation of a loom, for example, not less than 500 r.p.m. (revolutions per minute), and is worn away greatly, the yarn fluffs in a short time, which causes the difficulty in continued weaving. However, to improve surface hardness, for example, TiN coating by physical vapour deposition (PVD) or hard chromium plating is available. Although these plating methods can provide sufficient surface hardness, on the other hand, the methods involve a problem in that a coating or plating can easily peel due to the flexibility of guide bar blades since the adhesiveness of the base materials to the above coatings or platings is not sufficient.

In the meantime, a carbo-nitrided iron material easily rusts as same as the above stainless steel in case of being frequently exposed to water projection, for example, in a water jet loom. As a result, yarn passing through guide bar blades discolors so that this material is not suitable to make guide bar blades therefrom.

OBJECT OF THE INVENTION

In view of the forgoing, it is the object of this invention to provide a guide bar blade superior in wear resistance and also anti-corrosion wherein the surface of the blade is nitrided for hardening.

To accomplish the above object, a guide bar blade in the present invention is formed or made of metallic materials wherein the surface is nitrided for hardening.

SUMMARY OF THE INVENTION

Namely, the surface of a guide bar blade in this invention is nitrided for hardening. For this reason, the blade surface becomes harder than that heretofore in use, which results in the wear resistance required for high-speed operation of an automatic loom and also prevents the surface from rusting.

DETAILED DESCRIPTION OF THE PREFERRED EMBODIMENTS

Figure 1:
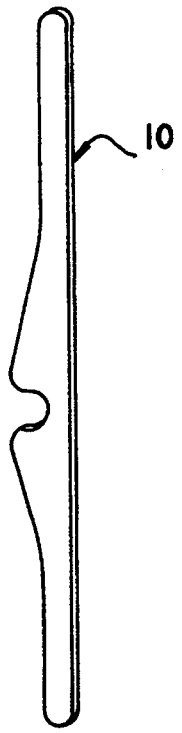
FIG. 1 is a view in perspective of the loom guide bar blade according to the invention.

The present invention is now described in further detail.

A guide bar in this invention whose surface is nitrided for hardening can be obtained by maintaining a guide bar blade in a heated condition under a fluorine- or fluoride-containing gas atmosphere and then maintaining the guide bar nitriding atmosphere to form the surface of the guide bar blade into nitride for hardening.

Materials for the above guide bar blade are not limited specifically and conventional metallic materials are employed. For example, there are austenitic stainless steels and ferritic stainless steels and the like. Among other, a nickel alloy is preferably employed in the present invention. As the above nickel alloy, those containing not less than 25 weight % nickel (abbreviated as % hereinafter) are mainly adopted. For example, there are Ni-Cr, Ni-Cr-Mo, Ni-Cr-Fe, Ni-Cr-Co and the like. Specifically, there are alloys with a high nickel content such as inconel, hastelloy, and incolloy. In addition, nickel alloys having less than 25% nickel content are included in the present invention. Therefore, nickel alloys both with not less than 25% nickel content and less than 25% are included in materials for the loom guide bar blade in the present invention. It is preferable that an alloy which contains not less than 25% nickel, not more than 25% iron and also not less than 5% chromium or molybdenum is employed.

Then, the guide bar blade, in general, is obtained by a process of cold punching the above metallic materials into a desired shape and polishing and the like. Furthermore, the thickness of the loom guide bar blade is set within 0.2 to 0.3 mm.

Fluorine- or fluoride-containing gas for a fluorine- or fluoride-containing gas atmosphere, in which the above-mentioned loom guide bar blade formed of metallic materials such as the above nickel alloys is treated, is fluorine compound gas, such as $NF_3$, $BF_3$, $CF_4$, HF, $SF_6$, $C_2F_6$, $WF_6$, $CHF_3$, or $SiF_4$. They are used independently or in combination. In addition, a fluorine compound gas with F in its molecule can be used as the above-mentioned fluorine- or fluoride-containing gas. Also $F_2$ gas formed by cracking fluorine compound gas in a heat decomposition device and preliminarily formed $F_2$ gas are employed as the above-mentioned fluorine- or fluoride-containing gas. According to the case, such fluorine compound gas and $F_2$ gas are mixed for the use. The above-mentioned fluorine or fluoride-containing gas such as the fluorine compound gas and $F_2$ gas can be used independently, but generally are diluted by inert gas such as $N_2$ gas for the treatment. The concentration of the fluorine- or fluoride-containing gas itself in such diluted gas should amount to, for example, 10,000 to 100,000 ppm, preferably 20,000 to 70,000 ppm, more preferably 30,000 to 50,000 ppm.

In the invention, the above unnitrided loom guide bar blade is placed into the fluorine- or fluoride-containing gas atmosphere of the above concentration and held in a heated condition to be fluorinated. This is the most characteristic part of the invention. In this case, the guide bar blade is held with heating at a temperature of, for example, 350° to 600° C. The holding time of the above loom guide bar blade in a fluorine- or fluoride-containing gas atmosphere may appropriately be selected depending on the nickel alloy species, geometry and dimension of the guide bar blade, heating temperature and the like, generally within the range of ten or so minutes to scores of minutes. The treatment of the loom guide bar blade in such a fluorine- or fluoride-containing gas atmosphere allows "N" atoms to penetrate into its material, for example, nickel alloy, which was impossible in the past. Though the mechanism of the penetration has not yet been proven at present, it can be understood as follows on the whole. That is, the oxidized layer of NiO formed on the loom guide bar blade surface inhibits "N" atoms for nitriding from penetration. Upon holding nickel alloy with an oxidized layer in a fluorine- or fluoride-containing gas atmosphere with heating as mentioned above, the oxidized layer of NiO is converted to a fluorinated layer of $NiF_2$. "N" atoms for nitriding penetrate more readily into the fluorinated layer of $NiF_2$ than into the oxidized layer of NiO, that is, the surface is formed to the suitable condition for the penetration of "N" atoms by the above-mentioned fluorination. Thus, it is considered that "N" atoms in the nitriding gas penetrate uniformly into the nickel alloy to the certain depth when nickel alloy is held in a nitriding atmosphere with the suitable surface condition to absorb "N" atoms as follows, resulting the formation of a deep uniform nitrided layer.

Then, as mentioned above, the loom guide bar blade with suitable surface condition to absorb "N" atoms by fluorination is held with heating in a nitriding atmosphere so as to nitride. In this case, a nitriding gas for a nitriding atmosphere is a simple gas composed of $NH_3$ only, or a mixed gas composed of $NH_3$ and a carbon source gas (for example, RX gas). A mixture of both gases can be also used. Generally, the above-mentioned simple gas mixed with an inert gas such as $N_2$ is used. According to the case, $H_2$ gas is added to those gases.

In such a nitriding atmosphere, the above-mentioned fluorinated loom guide bar blade is held with heating. In this case, a heating condition is generally set at a temperature of 500° to 700° C., and treatment time is set within the range of 3 to 6 hours. By this nitriding treatment, a close nitriding layer (consisting of entirely single layer) is formed uniformly on the surface of the above-mentioned loom guide bar blade, whereby the surface hardness of the loom guide bar blade reaches Hv not less than 600, normally Hv of 800 to 1100 in comparison with that of base material thereof Hv of 280 to 380. The thickness of the hardened layer basically depends on the nitriding temperature and time, and is normally formed in a thickness of 20 to 30 $\mu$m. However, the temperature not more than 500° C. causes difficulty in forming a nitriding layer, and at a temperature not less than 700° C., a fluorinated layer is damaged and Ni is easily oxidized thereby resulting in a tendency of forming an uneven nitrided layer. Moreover, the surface roughness of the nitrided hardened layer deteriorates, which causes defects as a product.

On the other hand, a sufficient fluorinated layer ordinarily can not be formed at the fluorinating temperature not more than 350° C. Also the temperature not less than 600° C. is not appropriate for an industrial process because furnace materials in a muffle furnace are worn out due to extreme fluorinating reaction. From a viewpoint of forming a nitrided hardened layer, it is also preferable that the difference between fluorinating temperature and nitriding temperature be as small as possible. For example, a proper nitriding layer is not formed by nitriding given after fluorinating and cooling once.

Figure 3:
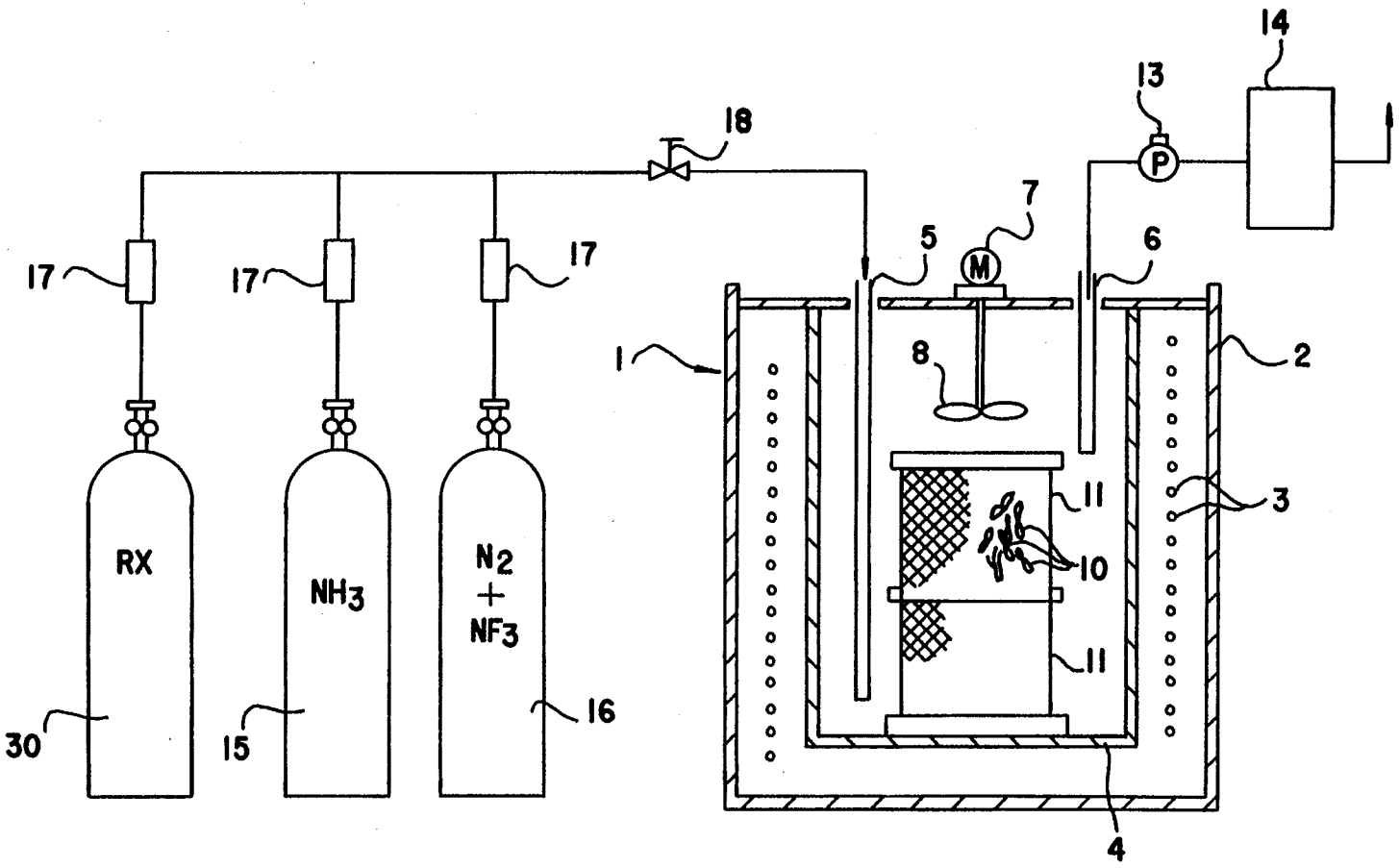

The above-mentioned fluorinating and nitriding steps are, for example, taken in a metallic muffle furnace as shown in FIG. 3, that is, the fluorinating treatment is carried out first, and then nitriding treatment is put in practice inside of the muffle furnace. In FIG. 3, the reference numeral 1 is a muffle furnace, 2 an outer shell of the muffle furnace, 3 a heater, 4 an inner vessel, 5 a gas inlet pipe, 6 an exhaust pipe, 7 a motor, 8 a fan, 11 a wire-netting container, 13 a vacuum pump, 14 a noxious substance eliminator, 15, 16 and 20 cylinders, 17 flow meters, and 18 a valve. A loom guide bar blade 10 is placed in the furnace 1 and fluorinated by introducing fluorine- or fluoride-containing gas atmosphere such as $NF_3$ with heating through a passage connected with a cylinder 16. The gas is led into the exhaust pipe 6 by the action of vacuum pump 13 and detoxicated in the noxious substance eliminator 14 before being vented out. And then, the cylinder 15 and 20 are connected with a duct to carry out nitriding by introducing nitriding gas into the furnace 1. After nitriding, the gas is vented out via the exhaust pipe 6 and the noxious substance eliminator 14. Through the series of these operations, fluorinating and nitriding treatments are put in practice. High-nickel based heat resistance alloy is desirable as material for the above-mentioned metallic muffle furnace 1 instead of stainless steel. That is, since stainless steel is easier to be fluorinated than high-nickels and as a result fluorinating temperature must be set at a high temperature, a large amount of expensive fluorine- or fluoride-containing gas are required.

The adoption of $NF_3$ as fluorine- or fluoride-containing gas is suitable in particular for the above-mentioned fluorinating. That is, $NF_3$ is a handy gaseous substance that has no reactivity at the ordinary temperature thereby allowing the operations and detoxication of the exhaust gas to be easy.

EFFECT OF THE INVENTION

As mentioned hereinbefore, the surface of the loom guide bar blade in the present invention is nitrided for hardening. That is, first of all, an oxidised layer on the surface of a metal as a forming material for the loom guide bar blade is converted to a fluorinated layer, and then nitrided, whereby the surface layer can be formed into a nitrided hardened layer. Thus, generally, for example, nickel alloys contain Cr, Mo or the like which are easy to react with "N" atoms to form an hard intermetallic compound such as CrN, MoN or the like. Since such a fluorinated layer can transmit "N" atoms in nitriding for hardening, "N" atoms can penetrate uniformly into the nickel alloy surface layer in the certain depth at the time of nitriding. As a result, the uniform penetration can lead to the formation of a close uniform nitrided layer in the depth only in the nickel alloy surface layer and the drastic improvement of surface hardness without raising the stiffness of the base material nickel alloy. Since the nitrided and hardened surface according to the present invention has excellent wear resistance in a high-speed rotation of a modern automatic high-speed loom, yarn does not fluff, different from the conventional method, moreover, yarn does not discolor because rusting is not caused in an automatic loom adopting a water jet method. Therefore, woven fabric in high quality can be obtained and operation ratio of looms themselves can be improved. Furthermore, the durability of loom guide bar blade is improved, which facilitates maintenance and inspection such as reciprocation.

The following modes for carrying out the invention illustrate the invention.

EXAMPLE 1

Nickel alloy material of 76Ni-16Cr-8Fe was prepared and processed to a sheet in 0.19 mm thick. This sheet of nickel alloy material was cold-punched to form a loom guide bar blade 10 which was 0.19 mm thick and in a shape shown in FIG. 1. Then, the above loom guide bar blade 10 was charged into the furnace 1 shown in FIG. 3. After vacuum purging the inside of the furnace, it was heated to 550° C. Then, in that state, fluorine- or fluoride-containing gas ($NF_3$ 10 Vol %+$N_2$ 90 Vol %) was introduced into the furnace to form an atmospheric pressure in it and the condition was maintained for 15 minutes. Then after exhausting the above-mentioned fluorine- or fluoride-containing gas out of the furnace, nitriding gas [$NH_3$ 50 Vol%+RX gas (CO 21%+$H_2$ 32%+$CO_2$ 1%+$N_2$ 46%) 50%] was introduced into the furnace and the inside of the furnace was maintained at a temperature of 550° C . After nitriding treatment was carried out in this condition for 3 hours, the loom guide bar blade was removed.

Figure 2:
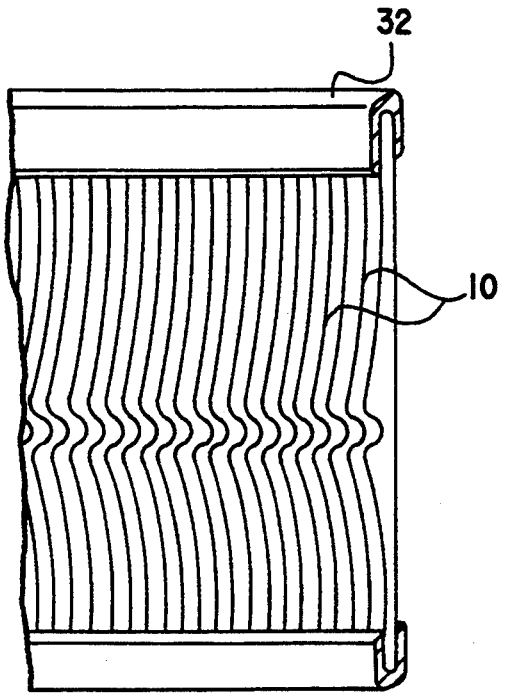
FIG. 2 is a partially cutaway view in perspective of a the loom guide bar blade incorporated into the frame according to the invention, and FIG. 3 schematically shows a construction of a treatment furnace for carrying out nitriding according to the present invention.

The hardness of thus nitrided loom guide bar blade was checked. Vickers hardness reached Hv of 880 to 900 and the thickness of the nitrided hard layer was 20 μm, which uniformly formed all over the surface of the guide loom bar blade. In addition, the guide bar blade was incorporated into a frame 31 shown in FIG. 2 to be installed in an automatic loom of a water jet system so as to be driven. As a result, compared with a conventional loom guide bar blade made of metastable stainless steel, occurrence ratio of warp fluffing drastically decreases. Furthermore, there is no trouble to cause discoloration due to rusting and woven fabric in high quality was obtained.

EXAMPLE 2

Nickel alloy material of 76Ni-16Cr-8Fe was prepared and processed to a sheet which was 0.19 mm thick. This sheet of nickel alloy material was cold-punched to form a loom guide bar blade 10 which was 0.19 mm thick and in a shape shown in FIG. 1. Then, the above loom guide bar blade 10 was charged into the furnace 1 shown in FIG. 3. After vacuum purging the inside of the furnace, it was heated to 350° C. Then, in that state, fluorine- or fluoride-containing gas ($NF_3$ 10 Vol %+$N_2$ 90 Vol %) was introduced into the furnace to form an atmospheric pressure in it and the condition was maintained for 15 minutes. Then after exhausting the above-mentioned fluorine- or fluoride-containing gas out of the furnace, nitriding gas ($NH_3$ 50 Vol %+RX gas 50%) was introduced into the furnace and the inside of the furnace was maintained at a temperature of 700° C. After the nitriding treatment was carried out in this condition for 3 hours, the loom guide bar blade was removed.

The hardness of thus nitrided loom guide bar blade was checked. Vickers hardness reached Hv of 880 to 900 and the thickness of the nitrided hard layer was 20 μm, which uniformly formed all over the surface of the guide loom bar blade. In addition, the loom guide bar blade was incorporated into a frame 32 shown in FIG. 2 to be installed in an automatic loom of a water jet system so as to be driven. As a result, compared with a conventional loom guide bar blade made of metastable stainless steel, the rate of occurrence of warp fluffing drastically decreases. Furthermore, there is no discoloration due to rusting and a woven fabric in high quality was obtained.

What are claimed are:

1. A loom guide bar blade comprising an elongated sheet having a longer dimension and a shorter dimension and two opposed edges along the longer dimension, one of the edges being essentially linear and the other edge having a central notch, the blade being made of nickel alloy having a nitrided hardened layer formed on a surface of the nickel alloy, the hardened layer containing nitrides of the nickel alloy.

2. A loom guide bar blade according to claim 1 wherein the nickel alloy is not less than 25 weight % of nickel content, not more than 25 weight % of iron and not less than 5 weight % of chromium or molybdenum.

3. A loom guide bar blade according to claim 1 wherein the nitrided layer is formed by pretreatment with fluorine- or fluoride containing gas and subsequent treatment with nitriding gas.

4. A loom guide bar blade according to claim 1, wherein the hardened layer has a hardness of at least 600 Hv.

5. A loom guide bar blade according to claim 4, wherein the hardened layer has a hardness of 800–1100 Hv.

6. A loom guide bar blade according to claim 4, wherein the hardened layer has a thickness of 20–30μ.

7. A loom guide bar blade comprising an elongated sheet having a longer dimension and a shorter dimension and two opposed edges along the longer dimension, one of the edges being essentially linear and the other edge having a central notch, the blade being made of nickel alloy having a nitrided hardened layer formed on a surface of the nickel alloy material, the hardened layer containing nitrides of the nickel alloy and being formed by pretreatment with fluorine- or fluoride-containing gas and subsequent treatment with nitriding gas.

8. A loom guide bar blade according to claim 7 wherein the nickel alloy is not less than 25 weight % of nickel content, not more than 25 weight % of iron and not less than 5 weight % of chromium or molybdenum.

9. A loom guide bar blade according to claim 7, wherein the hardened layer has a hardness of at least 600 Hv.

10. A loom guide bar blade according to claim 9, wherein the hardened layer has a hardness of 800–1100 Hv.

11. A loom guide bar blade according to claim 9, wherein the hardened layer has a thickness of 20–30μ.

* * * * *